US009790719B2

(12) United States Patent
Aykas

(10) Patent No.: US 9,790,719 B2
(45) **Date of Patent: *Oct. 17, 2017**

(54) CORNER FITTING WITH INCREASED CLAMPING FORCE

(71) Applicant: DORMA Deutschland GmbH, Ennepetal (DE)

(72) Inventor: Kenan Aykas, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 48 days.

This patent is subject to a terminal disclaimer.

(21) Appl. No.: 14/956,920

(22) Filed: Dec. 2, 2015

(65) Prior Publication Data

US 2016/0160544 A1 Jun. 9, 2016

(30) Foreign Application Priority Data

Dec. 4, 2014 (EP) ..... 14196264

(51) Int. Cl.
*E05D 5/02* (2006.01)
*E05D 7/081* (2006.01)
(Continued)

(52) U.S. Cl.
CPC ..... *E05D 5/0246* (2013.01); *E05D 7/00* (2013.01); *E05D 7/081* (2013.01); *E05D 11/00* (2013.01);
(Continued)

(58) Field of Classification Search
CPC E05D 5/02; E05D 5/0246; E05D 7/00; E05D 7/081; E05D 11/00; E05D 2005/0261; E05B 3/02
(Continued)

(56) References Cited

U.S. PATENT DOCUMENTS 6,766,561 B1 * 7/2004 Cheng ..... E05D 5/0246 16/235
6,925,685 B2 * 8/2005 Chen ..... E05D 5/0246 16/239
(Continued)

FOREIGN PATENT DOCUMENTS

DE 8618058 U1 8/1986
DE 8536840 U1 2/1990

*Primary Examiner* — Roberta Delisle
(74) *Attorney, Agent, or Firm* — Cantor Colburn LLP

(57) ABSTRACT

A corner fitting for a door element to be disposed on a center of rotation or an axis, including first and second fitting elements, which, at least sectionwise, each include a locating portion for the abutment against the door element, and are interconnectable while restraining the door element in a restraining area. The fitting elements delimit the restraining area, including at least one attaching unit for reliably clamping the door element between the fitting elements. The attaching unit includes first attaching means, disposed at the first fitting element and/or at the second fitting element, and second attaching means, disposed at the second fitting element and/or at the first fitting element. The attaching means are non-positively and/or positively interconnected. The first attaching means includes an engagement area, into which the second attaching means acts, wherein the engagement area extends at least partially into the restraining area via the locating.

15 Claims, 2 Drawing Sheets

(51) Int. Cl.
*E05D 7/00* (2006.01)
*E05D 11/00* (2006.01)
*E06B 3/02* (2006.01)

(52) U.S. Cl.
CPC ..... *E06B 3/02* (2013.01); *E05Y 2600/12* (2013.01); *E05Y 2600/502* (2013.01); *E05Y 2600/51* (2013.01); *E05Y 2600/62* (2013.01); *E05Y 2600/624* (2013.01); *E05Y 2600/626* (2013.01)

(58) Field of Classification Search
USPC ..... 16/252
See application file for complete search history.

(56) References Cited

U.S. PATENT DOCUMENTS

| | | | | |
|---|---|---|---|---|
| 9,506,280 | B2 * | 11/2016 | Aykas | E05D 5/0246 |
| 9,518,413 | B2 * | 12/2016 | Aykas | E05D 15/00 |
| 2005/0144757 | A1 * | 7/2005 | Chiang | E05D 5/0246 16/252 |
| 2009/0106937 | A1 * | 4/2009 | Bai | E05D 11/105 16/252 |
| 2016/0160548 | A1 * | 6/2016 | Aykas | E05D 5/0246 16/382 |
| 2016/0160556 | A1 * | 6/2016 | Herth | E06B 3/02 16/402 |
| 2016/0177619 | A1 * | 6/2016 | Aykas | E05D 1/00 16/402 |

* cited by examiner

CORNER FITTING WITH INCREASED CLAMPING FORCE

TECHNICAL FIELD

The present disclosure relates to a corner fitting for a door element to be disposed on a center of rotation and/or an axis.

BACKGROUND

It is generally known to equip doors, in particular glass doors with fittings, in particular with corner fittings. The fittings serve for example for affixing a lock or a lock strike box. Fitting devices configured as a corner fitting serve especially for disposing door elements, in particular glass doors, such as for example double-action glass doors or single-action glass doors, respectively sliding glass doors on a center of rotation and/or an axis, for example a BTS-axis. Most of the time, the prior art fittings or corner fittings include two fitting elements, between which the door element, for example a glass door, is restrained, respectively clamped between locating portions of the fitting elements. Moreover, it is known to adapt the corner fittings to different glass cutout standards. For some glass cutouts, the door element, in addition to being clamped in the restraining area, is additionally connected to the corner fitting via attaching units. For this purpose, in addition to the cutouts in the corner area, which is restrained between the fitting elements, the door elements include additional bores through which attaching means of the attaching units pass and reach non-positive and/or positive abutment at the fitting elements, respectively non-positively and/or positively interconnect the fitting elements and to the door element. The cutout in the corner area of the glass door elements mainly serves for forming a free space between the spaced apart fitting elements outside the locating portions. Said free space is utilized for supporting, respectively for mounting the door element on a center of rotation and/or an axis via the corner fitting, via a connecting element, which is a component of the corner fitting and which is preferably disposed between the fitting elements.

It is obvious that heavier door elements, which are restrained in the restraining area between the fitting elements, the clamping, respectively restraining force of the fitting elements, which indirectly acts upon the door element in the restraining area via the locating portion of the fitting elements, needs to be increased in order to be able to retain the door element safely. With the intention to increase the clamping force, it is known to modify the dimensions of the fittings according to the clamping force to be developed. Especially, this means that for deploying a larger clamping force, the prior art corner fittings need to be correspondingly dimensioned larger. Thus, for example universal fittings with the identification Jumbo are known from the manufacturer Teufelbeschlag. For deploying a clamping force, i.e. for deploying a tightening torque of for example 14 Nm, intended for reliably hold a heavy door element of 140 kg, the prior art fittings have an edge length of 200×84 mm with correspondingly dimensioned locating surfaces. A prior art fitting of said manufacturer for clamping a 200 kg heavy door element has an edge length of 260 mm×84 mm. Also die structural depth, i.e. the height of the caps of the prior art fittings increases considerably with increasing the dimensions of the prior art fittings.

Therefore, the disclosure provides a corner fitting, the clamping force thereof being variably modifiable, and which in particular compared to the prior art fittings can be considerably increased without changing the size of the fitting.

SUMMARY

The inventive corner fitting for a door element to be disposed on a center of rotation and/or an axis, includes a first fitting element and a second fitting element, which, at least sectionwise, each include a locating portion for the abutment against the door element, and are interconnectable while restraining the door element in a restraining area, wherein the fitting elements delimit the restraining area, moreover including at least one attaching unit for reliably clamping the door element between the fitting elements, wherein the attaching unit includes a first attaching means, which is disposed at the first fitting element and/or the second fitting element, and a second attaching means, which is disposed at the second fitting element and/or at the first fitting element, and the two attaching means are non-positively and/or positively interconnected, includes the technical teaching that the first attaching means includes an engagement area, into which the second attaching means acts, wherein the engagement area extends at least partially into the restraining area over at least one locating portion.

On the one hand, this solution offers the advantage that the attaching means of the attaching unit disposed at one or at both fitting elements may be configured independently of the material properties, the construction form and the construction depth of the fitting elements. If for example the fitting element is manufactured from grey cast iron or from another cast material, independently thereof the attaching means, which is disposed at the fitting element, can be manufactured from another material, i.e. here preferably from a more stable, respectively stronger material independently of the manufacturing type of the fitting elements. In the prior art fitting elements, an internal thread configured in the fitting elements serves as a reception, i.e. for the non-positive and/or positive connection to the other fitting element via an attaching means configured as a screw, wherein the clamping force for a door element restrained in the restraining area between the fitting elements is developed via the connection of the fitting elements. However, as the thread pitch, respectively the thread of the internal thread configured in the fitting element depends on the construction depth of the fitting element, the attaching means configured as a screw can only be non-positively and/or positively coupled to the relatively short configured internal thread. If in this case a too important tightening torque is applied to the screw for applying for example a very high clamping force, tearing out the thread in the fitting elements is pre-programmed. In contrast thereto, the inventive solution, namely the disposition of a first attaching means with an engagement area configured separately of the fitting elements, in addition to allowing for a different type of material property, also offers the possibility of configuring the engagement area beyond the construction depth of the fitting elements, respectively lengthen the engagement area for the attaching means. By lengthening the engagement area, which extends at least into the restraining area, i.e. between the fitting elements, according to the disclosure, it may be achieved that a second attaching means acting into the engagement area can be applied with a higher tightening torque than it was possible with the usual engagement area, which was delimited by the dimensions and in particular to the material thickness of the fitting element.

Accordingly, with the inventive arrangement of a first attaching means with an engagement area, which at least partially extends into the engagement area, at the fitting elements according to the disclosure, the clamping force to be applied to the fitting elements can be considerably increased at the fitting elements for the corner fitting having the same the dimensions, i.e. with the same edge lengths and material thickness, wherein they might be even reduced, if required. In this case, the increase of the clamping force increases proportionally to the tightening torque.

With the intention to achieve a possibly high non-positive and/or positive connection with the attaching unit, it is advantageous and provided in the inventive solution that the first attaching means extends beyond the construction depth of the fitting element towards the opposite fitting element. In the present case, this means that for the attaching means, which preferably has an engagement area for accommodating the second attaching means, the engagement area at least partially extends beyond the locating portion of the fitting element to the other fitting element. As the engagement area of the first attaching means extends between the fitting elements, the second attaching means, which is non-positively and/or positively accommodated in the engagement area, is already accommodated between the fitting elements by the first attaching means. In this case according to the disclosure, the first attaching means and the second attaching means form an attaching unit configured between the fitting elements, which results in a higher clamping force and in improved stability of the corner fitting.

Advantageously, the second attaching means is configured as a screw element with a corresponding male, respectively counter-thread, which advantageously can be non-positively and/or positively coupled to the engagement area, configured as an internal thread, of the first attaching means, and when coupled is located in the engagement area of the first attaching means. Advantageously, more than one attaching unit comprising a first and a second attaching means serve for generating the clamping force, i.e. for interconnecting the fitting elements.

With the intention to even increase the clamping force and the connection between the fitting elements, via the engagement area of the first attaching means extending between the fitting elements, i.e. here advantageously via the lengthened internal thread, which is configured as a thread pitch in the engagement area of the first attaching means, in an advantageous way the first attaching means with its thread configured as an internal thread, i.e. with the engagement area, is slightly offset to a reception at the opposite fitting element and accommodating the second attaching means. As the first attaching means and the second attaching means are disposed slightly offset to each other at the fitting elements opposite each other, when slightly offset engaging the second attaching means into the engagement area of the first attaching means, tension is caused between the fitting elements, whereby additionally the clamping force and the connection between the fitting elements is increased.

With the intention of even further increase the tightening torque, respectively the torque of the attaching unit, i.e. between the second attaching means, which engages in the engagement area of the first attaching means, advantageously, the first attaching means includes a profiled exterior contour, wherein the first and/or the second fitting elements include at least one reception, in which the first attaching means is retained. Advantageously in this case, the geometrics of the reception are adapted to the profiled exterior contour of the first attaching means. In a preferred way, the first attaching means replaces in this case an attaching means configured in the fitting elements. In a preferred way, the first attaching means is introduced in this case from outside into the fitting element through the fitting element, and advantageously here specifically at the location of the originally configured thread. Obviously, the first attaching means of the attaching unit may be also pressed into, hammer into or connected by substance to the fitting element. Advantageously, the head of the attaching means configured for example as a riveted nut comes to abut against the fitting element at the exterior side of the fitting element, i.e. at the side opposite the locating portion and extends with the engagement area opposite the head part beyond the locating portion of the fitting element towards the opposite fitting element. Obviously, the engagement area can extend as far as into the head part of the first attaching means such that the engagement area extends over the entire length of the first attaching means. In addition to increasing the tightening torque respectively the torque, advantageously, the profiled exterior contour serves also for accommodating the first attaching means in a self-locking manner in the fitting element, such that for connecting the fitting elements, i.e. when applying the tightening torque, just the second attaching means needs to be rotated to advance into the counter-thread pitch configured as an internal thread, without requiring a manual rotation security of the second attaching means. The mounting and adjusting of the inventive corner fitting is thereby considerably simplified.

With the intention to even further increase the tightening torque, respectively the torque between the first and the second attaching means, advantageously, the first attaching means includes a multi-edged exterior envelope surface, respectively a multi-edged profiled exterior contour. Preferably, the profiled exterior contour may be a 3-edge contour, a 4-edge contour, a 5-edge contour or a 6-edge contour. Obviously, it is also conceivable to configure the profiled exterior contour multi-serrated, for example as a four, five or six serration. Obviously in this case, for inserting the first attaching means into the reception of the fitting element, the geometrics of the reception of the fitting element presents a 3-edge contour, a 4-edge contour, a 5-edge contour or a 6-edge contour or is configured to be multi-serrated as a four, five or six serration In an advantageous way, by lengthening the engagement area, which protrudes beyond the locating portion, of the first attaching means, which extends between the fitting elements, the tightening torque applicable at the attaching unit can be increased, wherein according to the disclosure and also preferably for increasing the tightening torque, the clamping force, which is adjustable between the fitting elements, can be increased. Correspondingly, independently of the construction size of the inventive corner fitting, by increasing, i.e. by lengthening the engagement area of the first attaching means and also in a preferred way by manufacturing the first attaching means form a stronger material compared to the material, from which the fitting elements are manufactured, the clamping force to be developed between the fitting elements can be increased, respectively raised.

Preferably, by changing at least two out of preferred three parameters, namely the material property of the first attaching means, the length of the engagement area of the first attaching means, which extends between both fitting elements, and finally the offset of the first attaching means to the second attaching means, which together form the attaching unit, while maintaining the dimensioning of the corner fitting, the clamping force can be increased, which acts from the two spaced apart opposite fitting elements onto the door element restrained in the restraining area.

Moreover, with the inventive attaching unit, it is redundant to change the configuration and in particular the size of the locating portions configured at the fitting elements, for possibly increasing the clamping force of the fitting device thereby.

Advantageously, with the here-described inventive corner fitting, it is possible without changing the size, i.e. without changing the length, the height and the construction depth, to apply a tightening torque of approximately 15 Nm or more to the attaching unit. This means, with the inventive corner fitting, by increasing the tightening torque to approximately 15 Nm or more, a door element can be accommodated between the fitting elements in the restraining area and a clamping force can be applied to the corner fitting, which allows for accommodating, respectively restraining a door element of 150 kg or heavier.

A normal fitting for example having an edge length of approximately 166×52 mm and the height thereof including the cap, i.e. the construction depth thereof reaching approximately 0.6 cm to 1.5 cm, wherein the construction depth may be even further reduced, by means of the inventive use of for example the first attaching means configured as a riveted nut can be configured for accommodating a 150 kg heavy glass door element.

In an advantageous manner, the at least one fitting element and in a preferred manner both fitting elements include a free space, in which the holding element is supported to be movable. According to the idea of the application, for example a recess in the shape of a slot or a io groove is understood as a free space, which extends in longitudinal extension of the fitting elements, at least in one of the fitting elements. According to the idea of the present disclosure, the distance created between the two fitting elements is also understood as a free space, which distance allows the holding element, which advantageously includes a head part and a connecting part, to move with the connecting part in the free space between the fitting elements. In contrast thereto, the free space, which extends in longitudinal extension of the fitting elements, serves for supporting the holding element with its head part to be movable, respectively for non-positively and/or positively accommodating the holding element via the head part.

In a particularly advantageous manner, the holding element and a connecting element, which is in an operative connection with the holding element and serves for supporting the door element on a center of rotation and/or the axis, are two interconnected structural components of the corner fitting. Preferably, said two interconnected structural components form the attaching mechanism, which is advantageously incorporated at both structural components, namely at the holding element as well as at the connecting element, and which mechanism can be transferred from a released condition into a fixing condition and back, wherein the holding element is displaceable at the fitting elements in the released condition, and in the fixing condition, it is at least non-positively and/or positively attached to at least one fitting element. Accordingly, on the one hand, the attaching mechanism formed at the holding element and at the connecting element serves for infinitely variably adjusting the corner fitting to a center of rotation and/or an axis, i.e. for infinitely variably displacing the holding element and the connecting element connected to the holding element in relation to the fitting elements and in particular in relation to the longitudinal extension of the fitting elements. Moreover, the attaching mechanism serves for at least non-positively and/or positively fixing the corner fitting in the adjusted position, namely for fixing the holding element via the attaching mechanism at least at one of the fitting elements. Accordingly, for adjusting the connecting element to the center of rotation and/or the axis, the holding element can be guided to be freely displaceable with the connecting element, i.e. according to the disclosure, it can be guided to be infinitely variably displaceable with regard to the longitudinal extension of the fitting elements. Once the position of the connecting element is adjusted to the center of rotation and/or to the axis, immobilizing the holding element and thereby also at least indirectly the connecting element is realized via the attaching mechanism by means of a non-positive clamped connection with at least one of the fitting elements via the holding element, which is preferably configured as a clamping plate.

In advantageous manner, the free space configured as a recess, a groove or a slot is configured in both fitting elements. The recess, the groove or the slot extend in this case in advantageous manner in longitudinal extension of both fitting elements and extend in the two fitting elements preferably at the same height and parallel to each other. Advantageously, the free space in the fitting elements referred to as recess, groove or slot serves for guiding the holding element essentially parallel to the fitting elements and in relation to the longitudinal extension thereof. Advantageously, for this purpose the holding element includes the head part, which serves for supporting the holding element, at least in the released condition of the attaching mechanism, to be movable in the free spaces of both fitting elements. Based on this configuration, in the fixing condition of the attaching mechanism, clamping of the holding element via the head part is effective at both fitting elements, namely respectively in the recesses of both fitting elements, whereby the clamping force acting during clamping is advantageously distributed equally on both fitting elements.

For a particularly large compliance of the corner fitting with different glass cutout standards and for increasing the clamping force, the fitting elements include at least one and preferably several receptions for accommodating respectively one attaching unit. Advantageously, for this purpose at least two receptions are provided for the attaching units in the fitting elements. Even more advantageous, the fitting elements include three or four receptions for the attaching units. In a particularly preferred way, five or six receptions are configured at or in the fitting elements for the attaching units. In this case, at least one reception, which is configured respectively at both fitting elements, serves at least for accommodating the first and/or the second attaching means of the attaching unit and for passing them through a through-hole, which is configured for example in the shape of a hole or of a bore in the door element restrained between the fitting elements.

This means that the reception is approximately congruent with the position of the through-hole configured in the door element through which the first and/or the second attaching means are guided through the door element.

In a preferred way, at least one first and one second receptions are provided at the fitting elements, which delimit the holding element, which is supported to be movable in the recess. Advantageously, this means that the holding element, which is supported to be movable in the recess, is disposed between the first and the second receptions.

In an advantageous way, the first and the second receptions, which delimit the recess for the holding element, are preferably located at one height with the recess, in particular at the same height with the recess. Obviously, the receptions may be located below or above the height of the recess.

However, in this case, disposing the receptions in direct adjency to the recess is particularly advantageous for directing loads on the door element towards the fitting elements by means of the holding element, which is supported to be movable in the recess, respectively by the forces transferred during operation from the support on the axis via the connecting element to the holding element, in direct closeness to the location of origin. Moreover, when applying in parallel a tightening torque to the attaching units, which are guided, respectively inserted into the receptions of the fitting elements in direct adjency to the recess, it can be determined without any problem whether or not the holding element is still movable in the entire longitudinal extension in the recess.

As the first and the second attaching means are introduced into the reception at the fitting elements, respectively passed through the through-holes, i.e. as separate structural components are at least positively connected to the fitting elements, the material properties thereof, i.e. the material or the substance, from which the first and the second attaching means are manufactured, may be different from the material used for the fitting elements, respectively from the substance used for the fitting elements Correspondingly the material properties of the first attaching means and of the second attaching means, namely all the material properties of the attaching unit, can be adapted to the tightening torque to be applied, i.e. to the clamping force of the corner fitting, independently of the material used for the fitting elements, respectively of the substance used for the fitting elements. Preferably, an attaching unit made from metal and even more preferred made from steel is suitable, wherein advantageously the materials are torsion-resistant and stainless. Obviously, the material properties of the first attaching means and of the second attaching means of the attaching unit may be as well different.

In a preferred way, the engagement area of the first attaching means extends with a length of up to 100% into the free space configured as a distance between the fitting elements. In this case, it is particularly advantageous that with a length of the engagement area, which is equal to the dimension of the distance formed between the fitting elements, the second attaching means with one of its ends, preferably front-sided, props up against the fitting element, which is opposite the fitting element having the reception for the second fitting element. It is thus allowed that attaching unit comprising the first attaching means and the second attaching means has a particularly stable embodiment and a particularly stabilizing effect on the corner fitting.

The principle of increasing the clamping force, which acts on the restraining area, should be understood according to the idea of the present disclosure for corner fittings and in particular for all door fittings no matter what type and shape. In particular locks and lock strike boxes, which need to be clamped to differently thick door leaves, in particular to glass doors having different glass thicknesses, respectively glass dimensions are understood as door fittings. In this case, the features mentioned in the description can be applied individually or in any combination also to the door fittings.

Hereinafter, further measures enhancing the disclosure will be illustrated in detail in conjunction with the description of one preferred exemplary embodiment of the disclosure based on the Figures.

BRIEF DESCRIPTION OF THE DRAWINGS

In the drawings.

Throughout the different Figures, same parts are always identified by the same reference numerals, and therefore they will be normally described once.

DETAILED DESCRIPTION OF THE DRAWINGS

Figure 1:
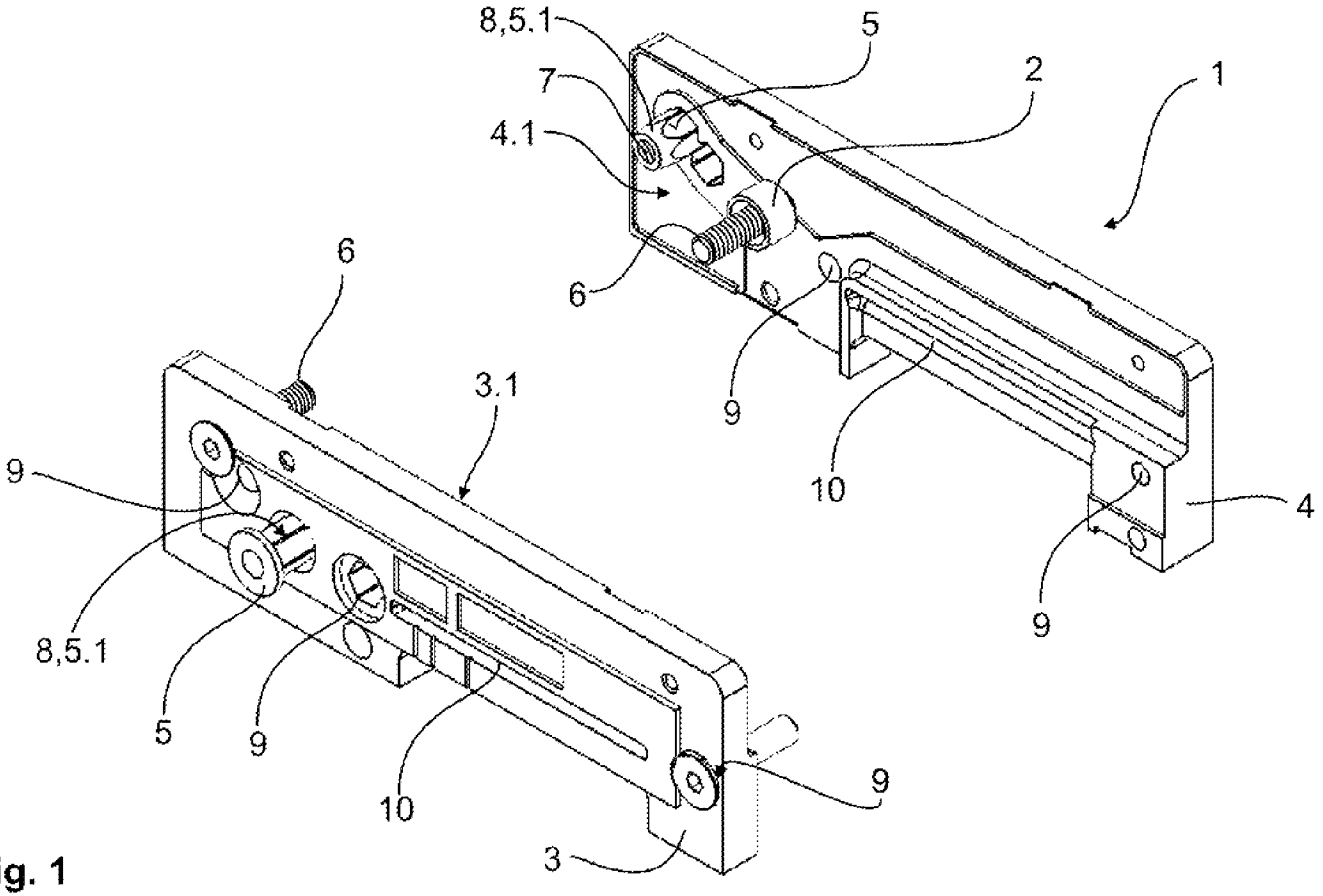
FIG. 1 shows a corner fitting reduced to the features essential to the disclosure in a perspective exploded view.

FIG. 1 shows a corner fitting 1 for a door element to be disposed on a center of rotation and/or an axis including a first fitting element 3 and a second fitting element 4. The fitting element 3 and the fitting element 4 include each at least sectionwise a locating portion 3.1 and 4.1. For illustration purposes, further elements of the corner fitting, such as the intermediate layers between the locating portions 3.1 and 4.1, and the door element, etc. have been omitted, wherein however the functioning of the illustrated corner fitting 1 should not to be limited.

Each of the fitting elements 3 and 4 includes receptions 9 for passing, respectively for inserting first attaching means 5 and second attaching means 6 there through, which serve for interconnecting the fitting elements 3 and 4. For this purpose, the attaching means are passed through through-holes in a door element restrained between the fitting elements 3 and 4. In the present case, the second attaching means 6 are screw elements in the shape of screws, which engage on both sides, i.e. both through receptions 9 of the fitting element 3 and through receptions 9 of the fitting element 4. Respectively on the opposite side of the second attaching means 6 inserted, respectively passed through the receptions 9, first attaching means 5 in the shape of riveted nuts are inserted into the receptions 9 of the fitting element 3 and of the fitting element 4.

The second attaching means 6 configured as screw elements and the first attaching means 5 configured as riveted nuts respectively form together one attaching unit for reliably clamping the door element with an appropriate clamping force between the fitting elements 3 and 4. The first attaching means 5 configured as riveted nuts include an engagement area 5.1, into which the second attaching means 6 configured as screw elements act. In this case, the engagement area 5.1 of the first attaching means 5 protrudes, respectively extends at least partially into the free space 11 formed via the locating portion 3.1 and 4.1, i.e. between the fitting elements 3 and 4. In the mounted condition of the corner fitting 1, the free space 11 is formed as a distance between the fitting elements 3 and 4. In the here illustrated condition of the inventive corner fitting 1, the engagement area 5.1 protrudes via the locating portion 3.1 and 4.1 of the fitting elements 3 and 4 beyond to the opposite fitting element 4 and 3. The engagement area 5.1 of the first attaching means 5 includes a thread 7 in the shape of an internal thread, which cooperates with a male thread configured as a counter-thread of the second attaching means 6 configured as screw element.

For the purposes of illustrating the profiled exterior contour 8, the first attaching means 5 configured as a riveted nut in the front fitting element 3 is illustrated to protrude to the front from the fitting element 3. The profiled exterior contour 8 of the first attaching means 5 configured as a riveted nut is multi-edged, in the present case as a hexagon, which serves for increasing the tightening torque, respectively the torque to be applied to the attaching unit and for self-locking the first attaching means 5, when the second attaching means 6 is brought to engage in the engagement area 5.1 of the first attaching means 5. So that the first attaching means 5 configured with a multi-edge contour in particular with an exterior hexagonal contour 8 can be inserted into the receptions 9 of the fitting elements 3 and 4 and if required can be removed again, and thereby assists the reception 9 in the torsion-locking of the first attaching means 5 configured multi-edged, the geometrics of the receptions 9 for the first attaching means 5 are adapted to the profiled exterior contour 8 of the first attaching means 5, i.e. in the present case configured as a multi-edge contour, in particular as an internal hexagon contour.

Both fitting elements 3 and 4 in their longitudinal extension include a recess 10, which serves for the mobile support of a holding element, which is operatively connected to a connecting element, via which the door element can be rotatably supported on an axis. Two receptions 9 are formed for the attaching means 5 and 6 at the left and right sides next to the recess 10 and almost at one height with the recess 10 in the fitting elements 3 and 4. In the illustration in the left area of the fitting elements 3 and 4 to the left upwards, three more receptions 9 are built in the fitting elements 3 and 4. Thereby, the inventive corner fitting 1 combines the most important standard glass cutouts, which are globally utilized. For preventing damage to the door element in the area of the through-hole of the attaching means 5 and 6, a sleeve 2 can be pushed or screwed at least over the second attaching means 6, which sleeve is positioned at least sectionwise over the threaded portion, i.e. the part or area of the second attaching means 6, which contacts the door element in the restraining area in the through-hole. Advantageously, the sleeve 2 is embodied from a plastic material or a rubber elastic material. It is in particular preferred, if the sleeve 2 is cut from a PVC-tube.

Figure 2:
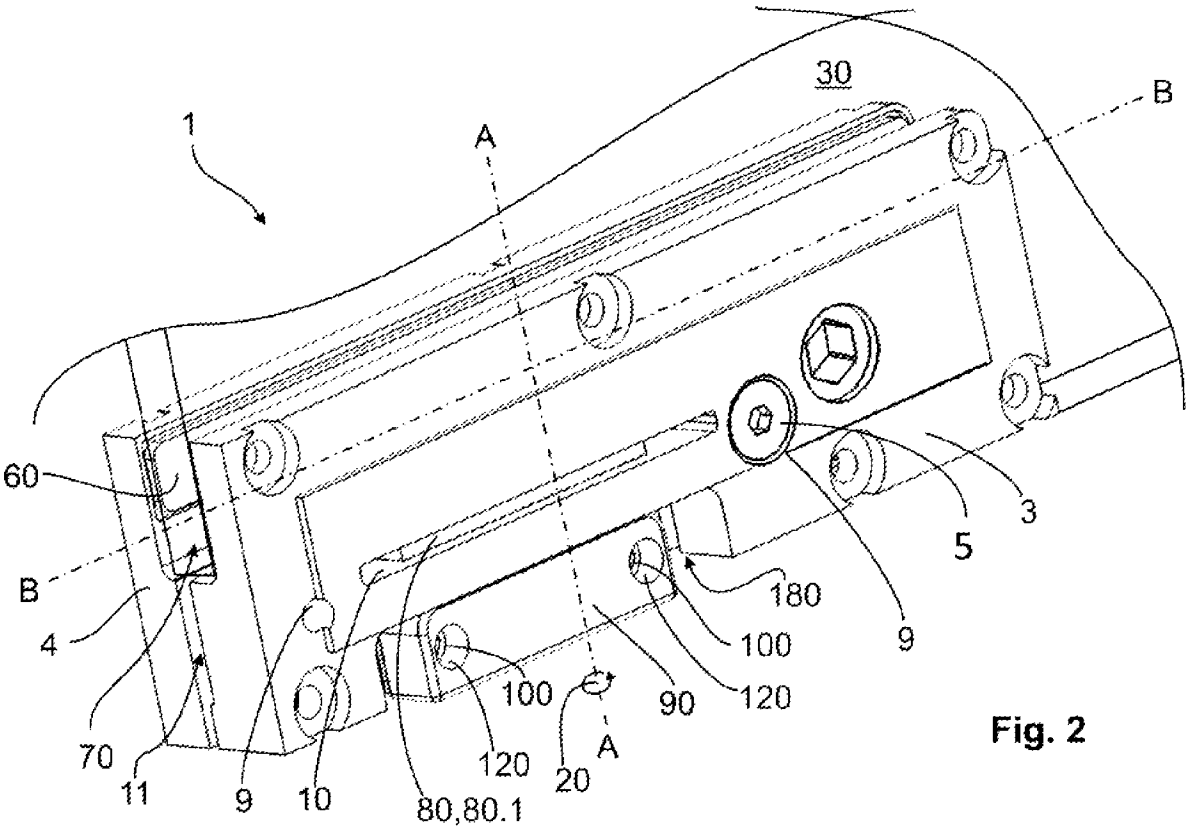
FIG. 2 shows an inventive mounted corner fitting, which is clamped to the left lower corner of a door element, in a perspective side view.

FIG. 2 shows a door element 30, which, via an inventive corner fitting 1, is supported on a center of rotation 20, which may be for example a BTS-axis (floor door closer axis). At the lower left corner of the door element 30, the corner fitting 1 is clamped to the door element 30. The corner fitting 1 illustrated in FIG. 2 is configured such as to be clampable as well to the top left or the top right or the lower right corner of the door element 30 for supporting the door element 30 on a center of rotation 2 and/or an axis. An attaching means 5 is introduced into the reception 9, which is embodied on the right side to the recess in the fitting element 3.

A restraining area 70, into which the door element 30 is insertable, is formed between the fitting elements 3 and 4. Preferably, intermediate layers 60, which are surrounded io by the locating portions 3.1 and 4.1, serve for preventing direct contact of the door element 30 with the fitting elements 3 and 4, in order to prevent for example damage to the door element 30, which is preferably a glass door element, when clamping in the fitting element 3 or 4, which is manufactured for example from grey cast iron. Moreover, the intermediate layers 60 preferably also serve for self-protecting the attaching means 5 and 6, wherein the intermediate layers 60 are at least partially elastically deformed, when the first attaching means 5 is brought into engagement with the second attaching means 6, whereby the clamping force is developed between the fitting elements 3 and 4, whereby the attaching means 5 and 6 are at least slightly pre-tensioned when being brought into engagement.

A holding element 80, which is displaceable in relation to the fitting elements 3 and 4, in particular in longitudinal extension of the fitting elements 3 and 4, is disposed between the two fitting elements 3 and 4. A connecting element 90, which is operatively connected to the holding element 80, serves for supporting the door element 30 on the center of rotation 20 and/or the axis. In the present case, the connecting element 90 is non-positively and/or positively operatively connected to the holding element 80 io via two attaching elements 100.

The holding element 80 in operative connection with the connecting element 90 is guided to be movable in a free space 10 configured as a recess 10 in the shape of a groove in the fitting element 3 and the fitting element 4. In this case, the recess 10 is configured in the shape of a groove parallel to the longitudinal extension of the fitting elements 3 and 4. The holding element 80 and the connecting element 90, which is in operative connection via the attaching elements 100, are thereby displaceable parallel along the recess 10, i.e. with regard to, respectively in the longitudinal extension of the fitting elements 3 and 4. As the connecting element 90 with the holding element 80 is displaceable in relation to the door element 30 in the opposite direction, the door element 30 can be infinitely variable aligned to the center of rotation 20 along the axis BB, for example in its position in a door frame or a glass door installation. In the event e.g. the center of rotation 20, respectively the axis of rotation of the door element 30, represented by the axis AA, is located outside the ranges determined for the standard centers of rotation 20, namely outside of 55 mm, 65 mm or 70 mm, the door element 30 may be adjusted to the center of rotation 20 and/or to the axis by displacing the holding element 80 and thereby with the connecting element 90, which is operatively connected to the holding element 80.

In the present case, the holding element 80 and the connecting element 90 are configured as two interconnected structural components comprising an attaching mechanism, which in the present case, is incorporated in both structural components, namely in the holding element 80 and in the connecting element 90. For transferring the attaching mechanism from a released condition, in which the holding element 80 is supported to be movable in the longitudinal extension of the fitting elements 3 and 4, into a fixing condition, the attaching elements 100, which connect the holding element 80 to the connecting element 90, are screwed into the through-holes 120. When screwing the attaching elements 100 into the holding element 80, the head part 80.1 of the holding element 80 gets clamped at least sectionwise non-positively in the recess 10 configured in the shape of a groove at the fitting elements 3 and 4. Thus, in the fixing condition of the attaching mechanism, the displaceability of the holding element 80 and of the connecting element 90 operatively connected to the holding element 80 is disabled, respectively the holding element 80 is immobilized in its position at the fitting elements 3 and 4.

With the intention to assist the movement of the holding element 80 and of the connecting element 90 operatively connected thereto in longitudinal extension of the fitting elements 3 and 4, a lower recess 180 is configured at the fitting elements 3 and 4, which is preferably formed parallel to the recess 10 configured as a groove and which preferably extends over the same length as a recess 10. Preferably in this case, the lower recess 18 is formed in both fitting elements 3 and 4 and preferably extends over the free space 11 formed between the fitting elements 3 and 4, from one to the other fitting element 3 and 4.

The invention claimed is:

1. A corner fitting for a door element to be disposed on a center of rotation and/or an axis, including a first fitting element and a second fitting element, which, at least sectionwise, each include a locating portion for the abutment against the door element, and are interconnectable while restraining the door element in a restraining area, wherein the fitting elements delimit the restraining area, including at least one attaching unit for reliably clamping the door element between the fitting elements, wherein the attaching unit includes a first attaching means, which is disposed at the first fitting element and/or at the second fitting element, and a second attaching means, which is disposed at the second fitting element and/or at the first fitting element, and the two attaching means are non-positively or positively interconnected, wherein the first attaching means includes an engagement area, into which the second attaching means acts, wherein the engagement area extends at least partially into the restraining area via the locating portion and/or the locating portion.

2. The corner fitting according to claim 1, wherein the engagement area includes a thread, which cooperates with a counter-thread of the second attaching means.

3. The corner fitting according to claim 1, wherein the engagement area is configured as an internal thread and the second attaching means includes a screw element located in the engagement area of the first attaching means.

4. The corner fitting according to claim 1, wherein the first attaching means includes a profiled exterior contour, wherein the first fitting element and/or the second fitting element include/s at least one reception, in which the first attaching means is retained, wherein the geometrics of the reception are adapted to the profiled exterior contour of the first attaching means.

5. The corner fitting according to claim 4, wherein the profiled exterior contour is a multi-edge contour.

6. The corner fitting according to claim 1, wherein a holding element is disposed between both fitting elements, which is displaceable in relation to the fitting elements, and the holding element is in operative connection with a connecting element, configured for supporting the door element on the center of rotation and/or the axis, wherein an attaching mechanism is incorporated at the holding element as well as at the connecting element, which is transferable between a released condition and a fixing condition, wherein, in the released condition, the holding element is displaceable at the fitting elements, and in the fixing condition the holding element is non-positively or positively attached at least to one fitting element.

7. The corner fitting (1) according to claim 6, wherein the holding element is movable along the longitudinal extension of at least one fitting element in a free space, wherein the free space includes a recess in at least one fitting element, and the holding element is supported in the recess to be movable.

8. The corner fitting according to claim 7, wherein the recess, in which the holding element is disposed to be movable, is provided between a first reception and a second reception.

9. The corner fitting according to claim 8, wherein the first reception and the second reception are located at one height, in relation to the height of the recess for the holding element.

10. The corner fitting according to claim 1, wherein the fitting element and/or the second fitting element include/s at least two receptions for accommodating attaching units.

11. The corner fitting according to claim 1, wherein a plurality of receptions are provided, the receptions being disposed at least partially offset in height with regard to the longitudinal extension of the recess in the fitting elements.

12. The corner fitting according to claim 1, wherein the attaching unit is configured such that a tightening torque of up to approximately 15 Nm can be applied to the fitting elements for achieving a reliable clamping of the door element.

13. The corner fitting according to claim 1, wherein the attaching unit is made from metal.

14. The corner fitting according to claim 1, further including a free space disposed between the fitting elements, wherein the engagement area with a length extends into the free space.

15. The corner fitting according to claim 1, wherein the fitting elements have a length of approximately 16 cm, a height of approximately 5 cm, and a depth from approximately 0.6 cm to approximately 1.5 cm.

* * * * *